US007279847B2

(12) United States Patent
Nerone et al.

(10) Patent No.: US 7,279,847 B2
(45) Date of Patent: Oct. 9, 2007

(54) PULSE STARTING CIRCUIT

(76) Inventors: Louis R. Nerone, 8058 Tanger Oval, Brecksville, OH (US) 44141; Laszlo S. Ilyes, 23860 Harms Rd., Richmond Heights, OH (US) 44143

( * ) Notice: Subject to any disclaimer, the term of this patent is extended or adjusted under 35 U.S.C. 154(b) by 0 days.

(21) Appl. No.: 11/313,099

(22) Filed: Dec. 20, 2005

(65) Prior Publication Data

US 2006/0220589 A1 Oct. 5, 2006

Related U.S. Application Data

(60) Provisional application No. 60/666,967, filed on Mar. 31, 2005.

(51) Int. Cl.
*H05B 37/00* (2006.01)

(52) U.S. Cl. ..... 315/209 R; 315/224; 315/DIG. 5

(58) Field of Classification Search ..... 315/224, 315/209 R, DIG. 5, 307
See application file for complete search history.

(56) References Cited

U.S. PATENT DOCUMENTS 5,075,599 A * 12/1991 Overgoor et al. ..... 315/224
5,406,177 A 4/1995 Nerone
5,952,790 A 9/1999 Nerone et al.
6,225,759 B1 * 5/2001 Bogdan et al. ..... 315/291

OTHER PUBLICATIONS

Philips Semiconductors; MHN-TD 70W Driver with UBA2030, 39 pages, Feb. 4, 1999.

* cited by examiner

*Primary Examiner*—David H. Vu

(57) ABSTRACT

A lamp ballast starting circuit and method for a gas discharge lamp is disclosed. The ballast starting circuit includes the inputs of the starting circuit connected to an inverter circuit, the starting circuit generating a pulse at the leading edge of each alternating half cycle of the inverter circuit output, the polarity of the pulse being the same as the polarity of each alternating half cycle of the inverter circuit output. The output of the starting circuit starts a gas discharge lamp.

20 Claims, 3 Drawing Sheets

Prior Art

PULSE STARTING CIRCUIT

This application claims priority to and the benefit of U.S. provisional application No. 60/666,967, filed Mar. 31, 2005, which application is incorporated herein by reference in its entirety.

BACKGROUND

This disclosure relates to a pulse starting method and circuit to pulse the primary winding of a high voltage transformer used to start a gas discharge (e.g. High Intensity Discharge (HID)) lamp. A gas discharge lamp typically uses a ballast circuit to convert an AC line voltage to a Low frequency bi-directional voltage. The ballast circuit includes a converter to convert the AC line voltage to a DC voltage and an inverter which converts the DC voltage to a Low frequency bi-directional voltage. The inverter can take the form of a series half-bridge or full bridge type connected to a DC voltage bus. In addition, a pulse starting circuit can be provided to cold start the gas discharge lamp.

One method and circuit to of igniting an HID lamp is a circuit as illustrated in FIG. 3. As illustrated in FIG. 4, this circuit provides a high voltage pulse 50 after a delay from the leading edge 52 of a ½ cycle of the bi-directional square waveform. The time delay before the start of the high voltage pulse 50 is determined by the RC circuit of FIG. 3. By providing a high voltage pulse 50 during each ½ cycle of the bi-directional square waveform, the Lamp is ignited.

A drawback of the method and circuit described above is the inability of the circuit of FIG. 3 to provide a high voltage pulse 50 at the start of each ½ cycle of the bi-directional square waveform, while providing an efficient pulse starting circuit during normal operations of the lamp. Providing a high voltage pulse at the start of a ½ cycle of the bi-directional square waveform provides relatively more time for an electrode to heat before the ½ cycle of the bi-directional square waveform changes polarity. This increased temperature of the electrode will provide a reduction in sputtering.

The inefficiencies of the circuit of FIG. 3 are related to R1 40. Specifically, R1 40 must be decreased to a small value to enable this circuit to generate a high voltage pulse near the beginning of a ½ cycle of the bi-directional square waveform. By decreasing R1 40 to a small value, this pulse starting circuit will draw relatively more current and power during normal operation of the gas discharge lamp and consequently be less efficient.

Accordingly, an improved efficient pulse starting method and circuit are needed to start a gas discharge lamp.

BRIEF DESCRIPTION

According to one embodiment of this disclosure, a ballast for a gas discharge lamp is provided. The ballast includes a DC voltage bus; a full-bridge inverter circuit including a DC voltage bus input and a bi-directional voltage output circuit, the bi-directional voltage output circuit generating a bi-directional voltage of alternating half cycles, and the DC voltage bus input of the full-bridge inverter circuit connected to the DC voltage bus outputs. In addition a starting circuit is provided, the starting circuit generating a pulse at the leading edge of each alternating half cycle and the polarity of the pulse being the same as the polarity of each alternating half cycle.

DETAILED DESCRIPTION

As briefly discussed in the background section, a pulse starting circuit can be utilized to provide a cold start for a gas discharge lamp.

The pulse position with respect to the low frequency square wave of voltage, prior to ignition, is important. This position determines how long the electrodes conduct before the polarity is reversed. Reversing polarity reverses the roles that each electrode plays, whether the electrode is a cathode or an anode. When it's a cathode, it emits electrons into the plasma and consequently loses temperature which is needed for thermionic emission. Without a high enough temperature, the electrode operating as a cathode can sputter tungsten onto the arc tube wall, reducing the luminous output of the lamp. When the electrode operates as an anode, it can absorb heat from the accelerating electrons. Therefore, after the gas breaks down, it is important to wait as long as possible before the electrode polarity changes. This provides the maximum time for the anode to heat before it takes on the role of a cathode. Thus, sputtering of tungsten can be minimized.

Figure 1:
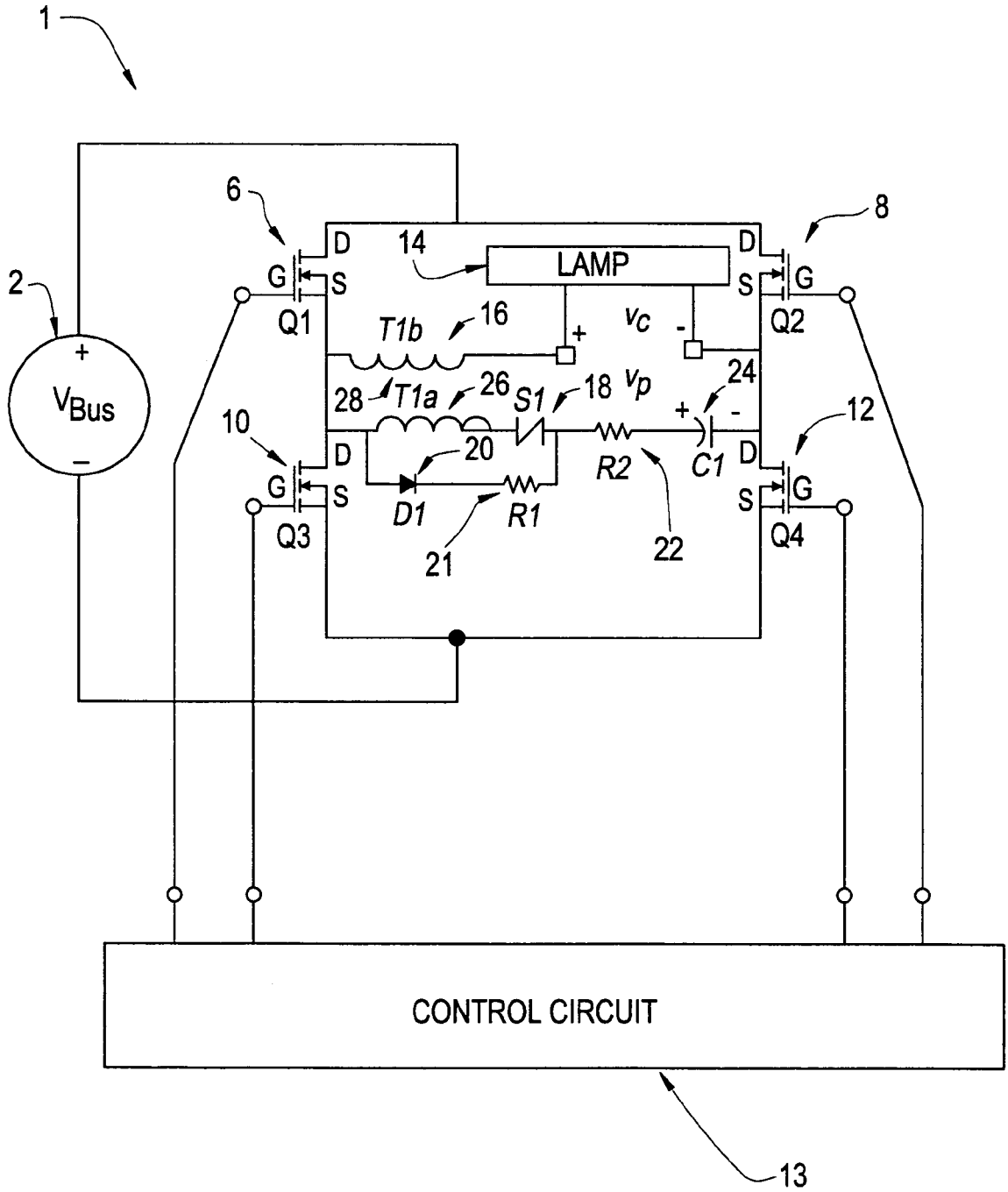
FIG. 1 illustrates a ballast circuit according to one embodiment of the disclosure.
Figure 2:
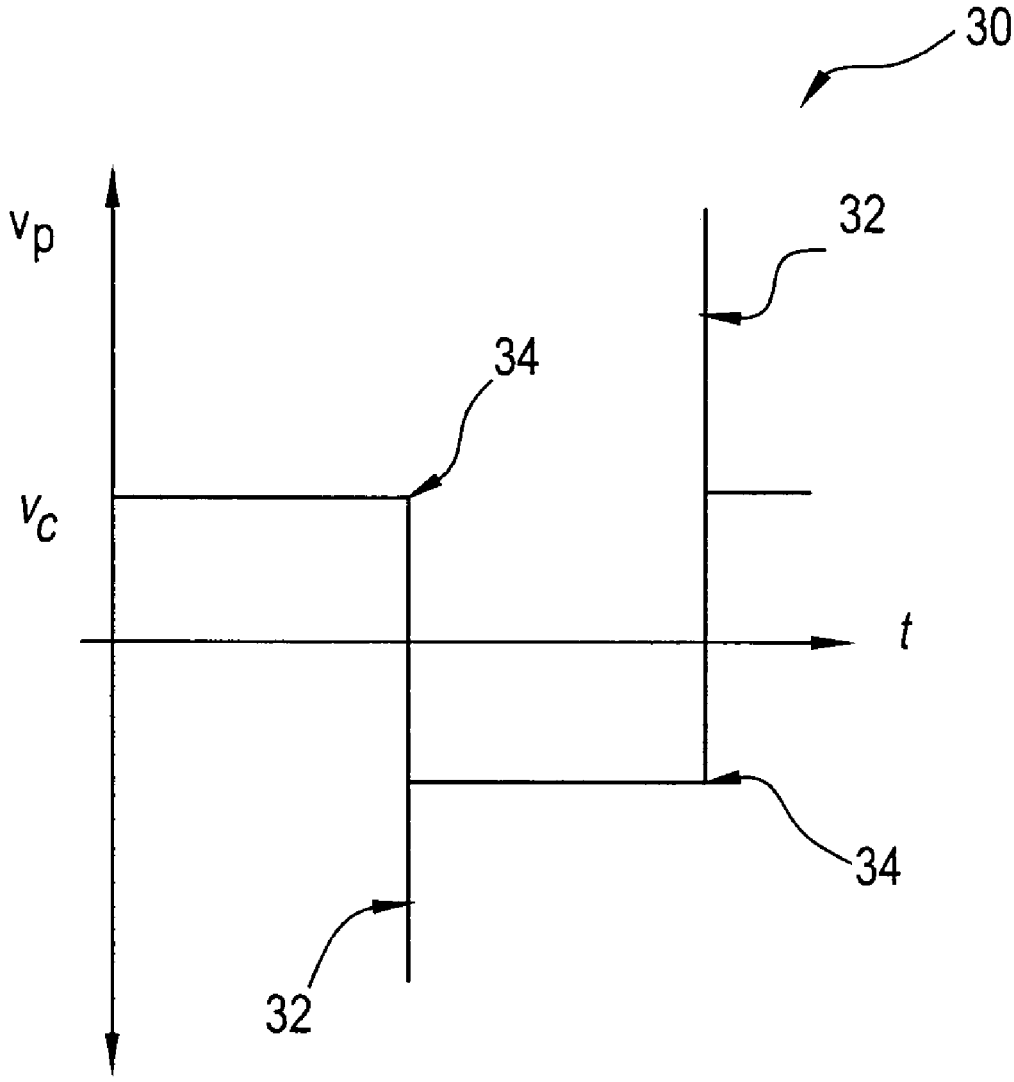
FIG. 2 illustrates a bi-directional voltage of alternating half cycles generated by the ballast circuit of FIG. 1.
Figure 3:
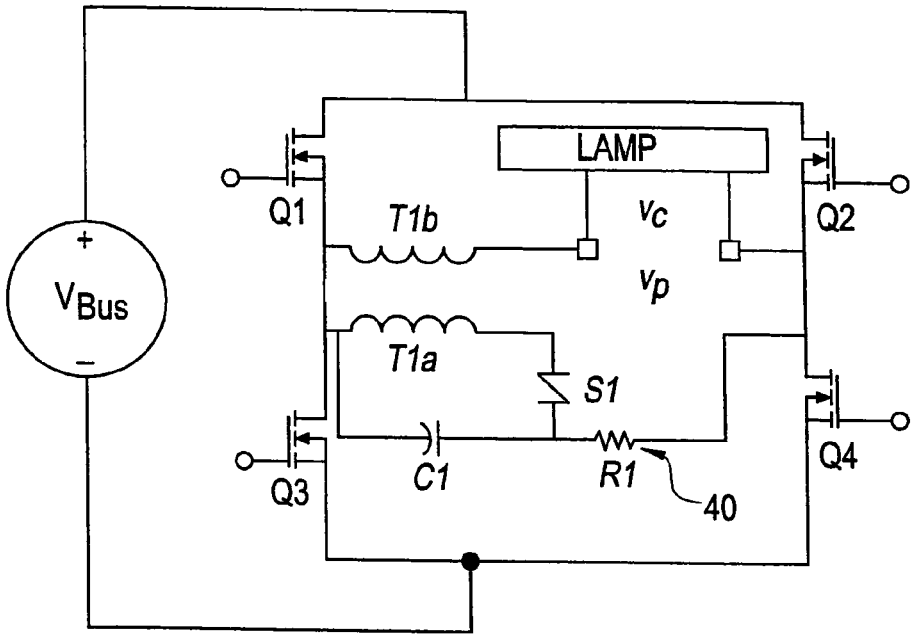
FIG. 3 illustrates a prior art ballast circuit.
Figure 4:
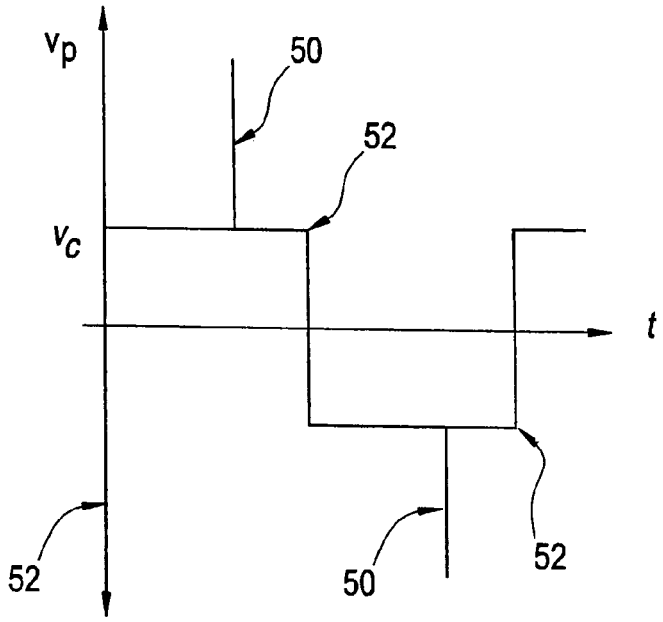
Prior Art FIG. 4
FIG. 4 illustrates a prior art voltage waveform generated by the circuit of FIG. 3.

The pulse starting circuit illustrated by FIG. 1 provides reduced sputter when starting a gas discharge lamp from a cold start and provides near zero power dissipation in the conducting mode after the lamp reaches breakover and the current is regulated. A reduction in sputter is achieved by the ballast circuit of FIG. 1 because this exemplary circuit produces the voltage waveform 30 illustrated in FIG. 2. Referring to FIG. 2, the pulse 32 occurring at the leading edge 34 of each ½ cycle of the bi-directional alternating voltage output $V_e$ of the ballast provides energy to the lamp electrodes at the start of each ½ cycle. The pulse 32 , occurring at the leading edge of the square wave, allows one full half-cycle of conduction to yield a maximum anode temperature before the bi-directional alternating voltage output changes polarity, thereby reducing sputter. Generating the pulse 32 at the leading edge 34 of the bi-directional alternating voltage ½ cycle provides more time within the bi-directional voltage ½ cycle for the electrodes temperature to increase, thereby providing a reduction in sputter relative to a similar pulse occurring later within the bi-directional voltage ½ cycle.

Illustrated in FIG. 1 is a circuit which generates the voltage waveform of FIG. 2 and described above. With reference to FIG. 1, a ballast circuit 1 according to one embodiment of this disclosure is illustrated. A DC voltage bus 2 generates a DC voltage and is connected to a full-bridge inverter circuit of the ballast. The DC voltage bus 2 operates according to embodiments and methods which are known to those of skill in the art. U.S. Pat. No. 5,406,177 by Nerone and U.S. Pat. No. 5,952,790 by Nerone et al. provide examples of DC voltage bus circuits used within a ballast circuit according to embodiments of this disclosure. U.S. Pat. No. 5,406,177 by Nerone and U.S. Pat. No. 5,952,790 by Nerone et al. are hereby totally incorporated by reference.

The full bridge inverter circuit includes transistors Q1 6, Q2 8, Q3 10, and Q4 12. The control circuit 13 operates to supply gate voltages to Q1 6 and Q4 12, simultaneously, for a ½ cycle of the desired bi-directional alternating voltage output. The gate voltages switch Q1 6 and Q4 12 to a conducting state which provides a DC bus voltage Vc to drive a lamp 14. During the subsequent ½ cycle of the desired bi-directional alternating voltage output, the control circuit operates to supply gate voltages to Q2 8 and Q3 10, simultaneously, for the ½ cycle. The gate voltages switch Q2 8 and Q3 10 to a conducting state which provides a negative DC bus voltage Vc to drive the lamp 14. The result of repeatedly switching Q1 6 and Q4 12, then Q2 8 and Q3 10, generates a bi-directional alternating voltage output with an amplitude approximately equal to the DC voltage bus.

The lamp starting circuit includes a transformer T1 16 including primary 26 and secondary 28 windings, a sidac S1 18, a diode D1 20, a resistor R1 21, a current limiting resistor R2 22 and a charging capacitor C1 24. The interconnections of these components are illustrated in FIG. 1.

After the full-bridge inverter circuit cycles a few times, approximately 1-10, during the cold lamp 14 turn on phase of lamp operations, C1 24 is charged during the Q1 6 and Q4 12 conducting state through diode D1 20, resistor R1 21 and resistor R2 22. The sidac S1 18 does not conduct until its breakover voltage is exceeded. This breakover voltage is selected to be nearly twice the minimum DC bus voltage. For example, a breakover voltage of 720 Volts, three 240 Volt sidacs connected in series, was selected to operate from a 450 Volt bus. Although not quite twice the DC bus voltage, the combined breakover voltage of three sidacs is about 720 Volts.

Resistor R2 22 is much less than resistor R1 21 for reasons that will be explained below. Resistor R1 21 is typically a value approximately equal to 2M ohms. Resistor R1 21 limits the amount of charge accumulated by capacitor C1 24 during the initial Q1 6 and Q4 12 conducting state, but will not reach the full DC bus voltage. During the subsequent initial Q2 8 and Q3 10 conducting state, current will not conduct through C1 24 because diode D1 20 blocks current flow through resistor R1 21 and the voltage across the sidac S1 18 is not sufficient to breakover the sidac S1 18. Consequently, the voltage across capacitor C1 24 does not change significantly from the voltage provided during the previous initial Q1 6 and Q4 12 conducting state. During subsequent Q1 6 and Q4 12 conducting states, capacitor C1 24 continues to charge, eventually charging to a voltage which will enable the sidac S1 18 to breakover. Breakover of sidac S1 18 occurs during the Q2 8 and Q3 10 conducting state after capacitor C1 24 charges to approximately the DC bus voltage during the Q1 6 and Q4 12 conducting state. The voltage across sidac S1 18 is equal to the DC bus voltage in addition to the voltage across capacitor C1 24. The total voltage across the sidac S1 18 can be nearly twice the DC bus voltage. Therefore, if the bus voltage is 450 Volts and the sidac S1 18 breakover voltage is 720 Volts for example, the sidac will fire sometime during the transition of the square wave causing a high voltage pulse to be generated during a polarity reversal. This allows the high voltage negative pulse to be generated across the lamp at the transition and yield a maximum warm-up time for the electrode should the lamp ignite during the upcoming ½ cycle. Breakover of sidac S1 18 creates a voltage across the primary winding T1*a* 26 of the transformer which generates a high negative voltage Vp at the lamp input through the secondary winding 28 of the transformer.

During the Q2 8 and Q3 10 conducting state, after the sidac S1 18 has initially broken over, capacitor C1 24 discharges through sidac S1 18 and charges to the negative DC bus voltage within one cycle of the Q2 8 and Q3 10 conducting state. During the subsequent Q1 6 and Q4 12 conducting state, the voltage across the sidac S1 18 will be approximately twice the DC bus voltage, enabling the sidac S1 18 to breakover and generate a high voltage Vp at the lamp input. During this Q1 6 and Q4 12 conducting state, capacitor C1 24 will discharge through sidac S1 18 and charge to the negative DC bus voltage. This cycle continues to repeat, generating a bi-directional voltage of alternating half cycle including a superimposed pulse, with no delay, at the leading edge of each alternating half cycle, the polarity of the pulse being the same as the polarity of each alternating cycle. The energy transfer associated with this charging pattern is orders of magnitude faster than what occurs through diode D1 20. This is why resistor R2 22 is selected to be relatively small in comparison to resistor R1 21. Since resistor R2 22 is used primarily as a damping element, its particular value is chosen to adjust the shape of the ignition pulse across the secondary winding 28.

The starting circuit continues to operate until the lamp 14 breaks over and the current is regulated, thereby causing the DC bus voltage to drop significantly (ex. 25 volts). The starting circuit charging capacitor C1 24 charges to the decreased bus voltage through diode D1 20, resistor R1 21 and resistor R2 22. Because the voltage across the sidac S1 18 never reaches the breakover voltage, the starting circuit does not trigger a pulse and remains disabled until the lamp 14 is turned off and back on, thereby increasing the DC bus voltage and restarting the pulse starting circuit as described.

The pulse starting circuit of this disclosure provides nearly zero power dissipation during normal operation of the lamp 14 when the starting circuit is not triggering. Nearly zero power dissipation is achieved because diode D1 20 prevents capacitor C1 24 from discharging through resistor R2 22 and resistor R1 21.

This disclosure has been described with reference to the exemplary embodiments. Obviously, modifications and alterations will occur to others upon reading and understanding the preceding detailed description. It is intended that the disclosure be construed as including all such modifications and alterations.

What is claimed is:

1. A ballast for a gas discharge lamp comprising:

a DC voltage bus including a positive connection point and a negative connection point;

a full-bridge inverter circuit including a DC voltage bus input and a bi-directional voltage output circuit including a first and a second output connection points, the bi-directional voltage output circuit generating a bi-directional voltage of alternating half cycles, and the DC voltage bus input of the full-bridge inverter circuit connected to the DC voltage bus outputs; and a starting circuit, including an input and output, the input of the starting circuit connected to the full-bridge inverter circuit, the starting circuit generating a voltage pulse at the leading edge of each alternating half cycle, the polarity of the voltage pulse being the same as the polarity of each alternating half cycle.

2. The ballast according to claim 1, the starting circuit further comprising:

a transformer including a primary (T1*a*) and a secondary (T1*b*) windings, the primary winding (T1*a*) including a first and a second connection points and the secondary winding including a first and a second connection points, the first connection point of the primary winding (T1*a*) connected to the first connection point of the secondary winding (T1*b*) and the first output connection point of the bi-directional voltage output;

a sidac (S1) including a first and a second connection points, the first connection point connected to the second connection point of the transformer primary winding (T1*a*);

a diode (D1), the anode connected to the first connection point of the transformer primary winding (T1*a*);

a first resistor (R1) including a first and a second connection point, the first connection points connected to the diode (D1) cathode;

a second transistor (R2) including a first and a second connection points, the first connection point connected to the sidac (S1) second connection point and the first resistor (R1) second connection point;

a capacitor (C1) including a first and a second connection points, the first connection point connected to the second connection point of the second resistor (R2) and the second connection point of the capacitor (C1) connected to the second output connection point of the bi-directional voltage output.

3. The ballast according to claim 2, wherein the bi-directional voltage of one or more positive half cycles initially charge the capacitor (C1) to a voltage approximately equal to the bi-directional voltage of the positive half cycle; the bi-directional voltage of a subsequent negative half cycle combined with the voltage across the capacitor (C1) produces a sufficient voltage to breakover the sidac (S1) and produce a pulse at the leading edge of the negative half cycle, the negative half cycle charging the capacitor (C1) to a voltage approximately equal to the bi-directional voltage of the negative half cycle; and the bi-directional voltage of a subsequent positive half cycle combined with the voltage across the capacitor (C1) produces a sufficient voltage to breakover the sidac (S1) and produce a pulse at the leading edge of the positive half cycle.

4. The ballast according to claim 2, wherein the breakover voltage of the sidac is approximately twice the minimum voltage of the DC voltage bus.

5. The ballast according to claim 2, wherein the transformer includes an approximate turn ratio of 20:1, the DC voltage bus equals approximately 450 volts, the sidac (S1) breakover voltage equals approximately 720 volts, the first resistor value is approximately 2M ohms, the second resistor value is approximately 10 ohms, and the capacitor (C1) value is approximately 100 nF.

6. The ballast according to claim 5, the full-bridge inverter circuit further comprising:

a first, a second, a third and a fourth transistor, each transistor including a gate, source and drain, the first transistor drain connected to the second transistor dram and the DC voltage bus positive connection point, the first transistor source connected to a first connection point of the starting circuit and the third transistor drain, the second transistor source connected to the fourth transistor drain and a second connection point of the starting circuit, and the third transistor source connected to the fourth transistor source and the DC voltage bus negative connection point.

7. The ballast according to claim 6, the full-bridge inverter circuit further comprising:

a control circuit, the control circuit connected to the first transistor gate, the second transistor gate, the third transistor gate and the fourth transistor gate, wherein the control circuit applies a voltage to the first transistor gate and the fourth transistor gate, simultaneously, for a first half cycle, and applies a voltage to the second transistor gate and the third transistor gate, simultaneously, for a second half cycle.

8. The ballast circuit according to claim 1, the full-bridge inverter circuit further comprising:

a first, a second, a third and a fourth transistor, each transistor including a gate, source and drain, the first transistor drain connected to the second transistor drain and the DC voltage bus positive connection point, the first transistor source connected to a first connection point of the starting circuit and the third transistor drain, the second transistor source connected to the fourth transistor drain and a second connection point of the starting circuit, and the third transistor source connected to the fourth transistor source and the DC voltage bus negative connection point.

9. The ballast according to claim 8, the full-bridge inverter circuit further comprising:

a control circuit, the control circuit connected to the first transistor gate, the second transistor gate, the third transistor gate and the fourth transistor gate, wherein the control circuit applies a voltage to the first transistor gate and the fourth transistor gate, simultaneously, for a first half cycle, and applies a voltage to the second transistor gate and the third transistor gate, simultaneously, for a second half cycle.

10. The ballast according to claim 9, the starting circuit further comprising:

a means for starting the gas discharge lamp by generating a pulse at the leading edge of each half cycle.

11. A ballast for a gas discharge lamp comprising:

a means for generating a DC voltage bus including a positive connection point and a negative connection point;

a means for generating a bi-directional voltage of alternating half cycles; and a means for generating a voltage pulse at the leading edge of each alternating half cycle, the polarity of the pulse being the same as the polarity of each alternating half cycle.

12. The ballast according to claim 11, the means for generating a pulse further comprising:

a transformer including a primary (T1*a*) and a secondary (T1*b*) windings, the primary winding (T1*a*) including a first and a second connection points and the secondary winding including a first and a second connection points, the first connection point of the primary winding (T1*a*) connected to the first connection point of the secondary winding (T1*b*) and the first output connection point of the bi-directional voltage output;

a sidac (S1) including a first and a second connection points, the first connection point connected to the second connection point of the transformer primary winding (T1*a*);

a diode (D1), the anode connected to the first connection point of the transformer primary winding (T1*a*);

a first resistor (R1) including a first and a second connection point, the first connection points connected to the diode (D1) cathode;

a second transistor (R2) including a first and a second connection points, the first connection point connected to the sidac (S1) second connection point and the first resistor (R1) second connection point;

a capacitor (C1) including a first and a second connection points, the first connection point connected to the second connection point of the second resistor (R2) and the second connection point of the capacitor (C1) connected to the second output connection point of the bi-directional voltage output.

13. The ballast according to claim 12, the means for generating a pulse further comprising:

the bi-directional voltage of one or more positive half cycles initially charging the capacitor (C1) to a voltage approximately equal to the bi-directional voltage of the positive half cycle; the bi-directional voltage of a subsequent negative half cycle combining with the voltage across the capacitor (C1) to produce a sufficient voltage to breakover the sidac (S1) and producing a pulse at the leading edge of the negative half cycle, the negative half cycle charging the capacitor (C1) to a voltage approximately equal to the bi-directional voltage of the negative half cycle; and the bi-directional voltage of a subsequent positive half cycle combining with the voltage across the capacitor (C1) producing a sufficient voltage to breakover the sidac (S1) and producing a pulse at the leading edge of the positive half cycle.

14. The ballast according to claim 12, wherein the transformer includes an approximate turn ratio of 20:1, the DC voltage bus equals approximately 450 volts, the sidac (S1) breakover voltage equals approximately 720 volts, the first resistor value is approximately 2M ohms, the second resistor value is approximately 10 ohms, and the capacitor (C1) value is approximately 100 nF.

15. The ballast according to claim 14, the means for generating a bi-directional voltage of alternating half cycles further comprising:

a first, a second, a third and a fourth transistor, each transistor including a gate, source and drain, the first transistor drain connected to the second transistor drain and the DC voltage bus positive connection point, the first transistor source connected to a first connection point of the starting circuit and the third transistor drain, the second transistor source connected to the fourth transistor drain and a second connection point of the starting circuit, and the third transistor source connected to the fourth transistor source and the DC voltage bus negative connection point.

16. The ballast according to claim 15, the means for generating a bi-directional voltage of alternating half cycles further comprising:

a control circuit, the control circuit connected to the first transistor gate, the second transistor gate, the third transistor gate and the fourth transistor gate, wherein the control circuit applies a voltage to the first transistor gate and the fourth transistor gate, simultaneously, for a first half cycle, and applies a voltage to the second transistor gate and the third transistor gate, simultaneously, for a second half cycle.

17. The ballast circuit according to claim 11, the means for generating a bi-directional voltage of alternating half cycles further comprising:

a first, a second, a third and a fourth transistor, each transistor including a gate, source and drain, the first transistor drain connected to the second transistor drain and the DC voltage bus positive connection point, the first transistor source connected to a first connection point of the starting circuit and the third transistor drain, the second transistor source connected to the fourth transistor drain and a second connection point of the starting circuit, and the third transistor source connected to the fourth transistor source and the DC voltage bus negative connection point.

18. The ballast according to claim 17, the means for generating a bi-directional voltage of alternating half cycles further comprising:

a control circuit, the control circuit connected to the first transistor gate, the second transistor gate, the third transistor gate and the fourth transistor gate, wherein the control circuit applies a voltage to the first transistor gate and the fourth transistor gate, simultaneously, for a first half cycle, and applies a voltage to the second transistor gate and the third transistor gate, simultaneously, for a second half cycle.

19. A method of operating a ballast circuit comprising:

generating a DC voltage bus;

generating a bi-directional voltage of alternating half cycles from the DC voltage bus; and generating a voltage pulse at the leading edge of each alternating half cycle, the polarity of the pulse being the same as the polarity of each alternating half cycle.

20. The method of operating a ballast circuit according to claim 19, further comprising:

driving a lamp with said bi-directional voltage and said voltage pulse.

* * * * *